US005396031A

United States Patent [19]

Lunati

[11] Patent Number: 5,396,031

[45] Date of Patent: Mar. 7, 1995

[54] MECHANICAL DEVICE ENSURING IRREVERSIBILITY IN A LIMITER ASSEMBLY FOR ACTUATORS COUPLED THROUGH A REVERSIBLE KINEMATIC CHAIN

[75] Inventor: Maurizio Lunati, Piacenza, Italy

[73] Assignee: Biffi, Italia S.R.L., Piacenza, Italy

[21] Appl. No.: 108,179

[22] Filed: Aug. 17, 1993

Related U.S. Application Data

[63] Continuation of Ser. No. 748,778, Aug. 22, 1991, abandoned.

[30] Foreign Application Priority Data

Dec. 11, 1990 [IT] Italy ..... 42543/90

[51] Int. Cl.[6] ..... H01H 3/16

[52] U.S. Cl. ..... 200/47; 74/136; 200/337; 200/573

[58] Field of Search ..... 200/573, 574, 329, 337, 200/338, 547, 47; 74/126, 136, 137

[56] References Cited

U.S. PATENT DOCUMENTS

| | | | |
|---|---|---|---|
| 424,451 | 4/1890 | Beck | 74/136 |
| 767,657 | 8/1904 | Otis | 74/126 |
| 2,441,634 | 5/1948 | Horman | 200/573 |
| 2,655,075 | 10/1953 | Lightburn et al. | 200/337 |
| 2,785,256 | 3/1957 | Nina | 200/573 |
| 2,897,680 | 8/1959 | Fritsch | 74/126 |
| 2,908,790 | 10/1959 | Pignone | 200/574 |
| 2,969,441 | 1/1961 | Showalter | 200/329 |
| 3,211,012 | 10/1965 | Yoshio Murai | 74/126 |
| 4,038,508 | 7/1977 | Mapelsden | 200/329 |
| 5,111,009 | 5/1992 | Chan et al. | 200/337 |

FOREIGN PATENT DOCUMENTS

| | | | |
|---|---|---|---|
| 2094557 | 9/1982 | United Kingdom | 200/574 |

*Primary Examiner*—Renee S. Luebke

*Attorney, Agent, or Firm*—Laff, Whitesel, Conte & Saret, Ltd.

[57] ABSTRACT

A mechanical device forms part of a limiter assembly associated with reversible electric actuators. Typically, such an actuator is for controlling pipeline valves. The limiter assembly comprises a mechanism by which one or more limiters can be held in the engaged position even after the trigger has been deactivated. The undesirable phenomenon of hunting or pumping (the effect of the actuator motor cutting in and out repeatedly) is prevented by a simple flexible ribbon with teeth positioned in such a way as to engage corresponding sprockets that are capable of rotation on their respective shafts in only one direction.

5 Claims, 2 Drawing Sheets

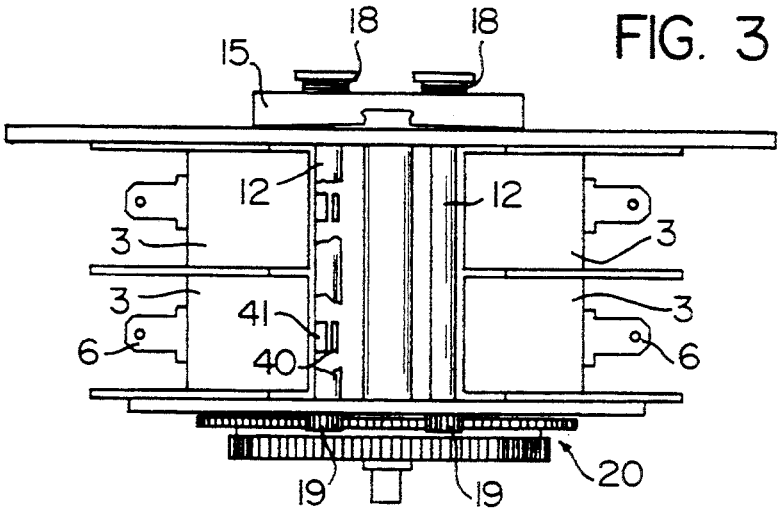
FIG. 3
FIG. 4
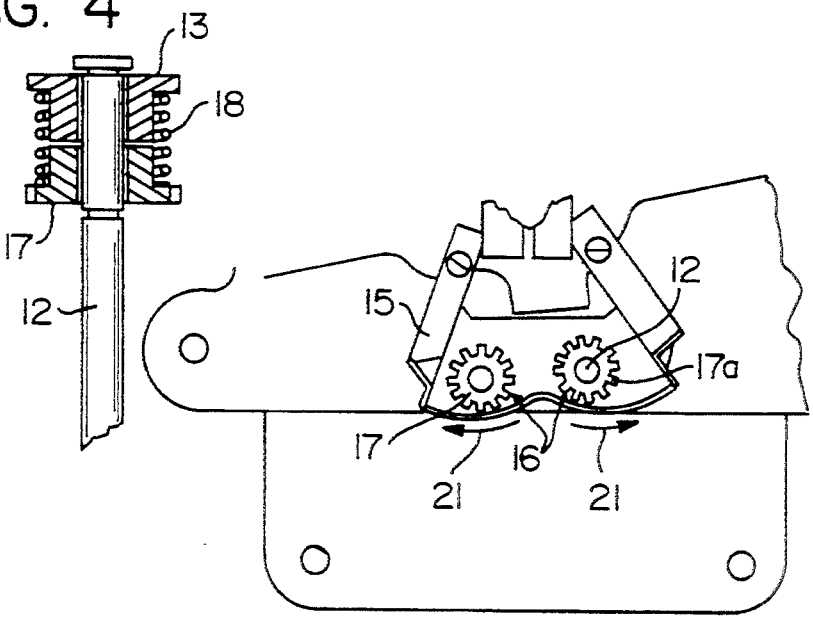
FIG. 5

MECHANICAL DEVICE ENSURING IRREVERSIBILITY IN A LIMITER ASSEMBLY FOR ACTUATORS COUPLED THROUGH A REVERSIBLE KINEMATIC CHAIN

This application is a continuation of application Ser. No. 07/748,778, filed Aug. 22, 1991, and now abandoned.

BACKGROUND OF THE INVENTION

The present invention relates to a mechanical device which ensures irreversibility in a limit switch assembly for electric actuators coupled through a reversible kinematic chain.

Electric actuators or motors of the type utilized for operating valves are equipped generally with electrical control units by which the movement of the actuator is arrested in positions corresponding to limit positions of the valve. The arrest position is triggered in most instances by a plurality of limit switches, preferably in the form of microswitches, which are operated by moving elements such as flexible tongues, which are independent of each other. The moving elements in their turn are operated by one or more cams carried by a shaft that is connected to a mechanical linkage forming part of the actuator system. The requisite torque of an electric actuator is generated by a motor, a speed reducer, and a worm gear driving a related wheel by means of which motion is transmitted to the valve.

In transmission of the torque, a movement produced by the worm gear acting against a related spring brings about the rotation of a shaft, the shaft in turn bringing about the operation of the limit switches by moving trigger elements mentioned above. In irreversibly coupled systems, on arrival, the worm gear remains in position at the limit even though the motor ceases to produce torque, and returns only when rotated in the opposite direction; thus, the limiter stays engaged.

On the other hand, in reversible systems the worm gear will bring about the operation of the microswitches and duly stop the motor. However the worm gear can then return under the influence of the spring, thereby releasing the switches and allowing the motor to restart if it is still able to do so. The result is that the motor is taken through a succession of stops and starts, giving rise to an undesirable phenomenon referred to as hunting or "pumping" by those skilled in the art.

Such repeated stopping and starting will ultimately damage the mechanical parts associated with the motor.

Hitherto the problem of hunting or pumping has been corrected by means of electrical type of devices which, however, are somewhat costly and which require a small control unit associated with the actuator. Moreover, such devices are often sold separately and must therefore be installed by the purchaser.

The object of the present invention is to overcome the drawbacks aforementioned, and in particular to provide a mechanical device suitable for emplacement directly into a limiter assembly and able to prevent the occurrence of hunting or pumping.

A further object of the invention is to render the embodiment of such a device extremely simple and economic.

SUMMARY of the INVENTION

The stated objects are realized in a mechanical device according to the present invention, which ensures irreversibility in the limiter assembly of an electric actuator coupled through a reversible kinematic chain. Mechanical means are provided that are capable of retaining one or more limiters in position, i.e. in engagement, even following a termination of the action of the trigger element by which engagement is brought about. Such means are connected, mechanically, on the one hand to elements by which the limiters are operated and on the other to rotary mechanical transmission components associated with the actuator.

BRIEF DESCRIPTION OF THE DRAWINGS

The invention will now be described in detail, by way of example, with the aid of the accompanying drawings, in which:

FIG. 3 is a front elevation of the device;

FIG. 4 shows a detail of a shaft device, viewed in section through a vertical plane;

FIG. 5 is a plan view of the device, seen in the operative condition.

DESCRIPTION of the PREFERRED EMBODIMENTS

Figure 1:
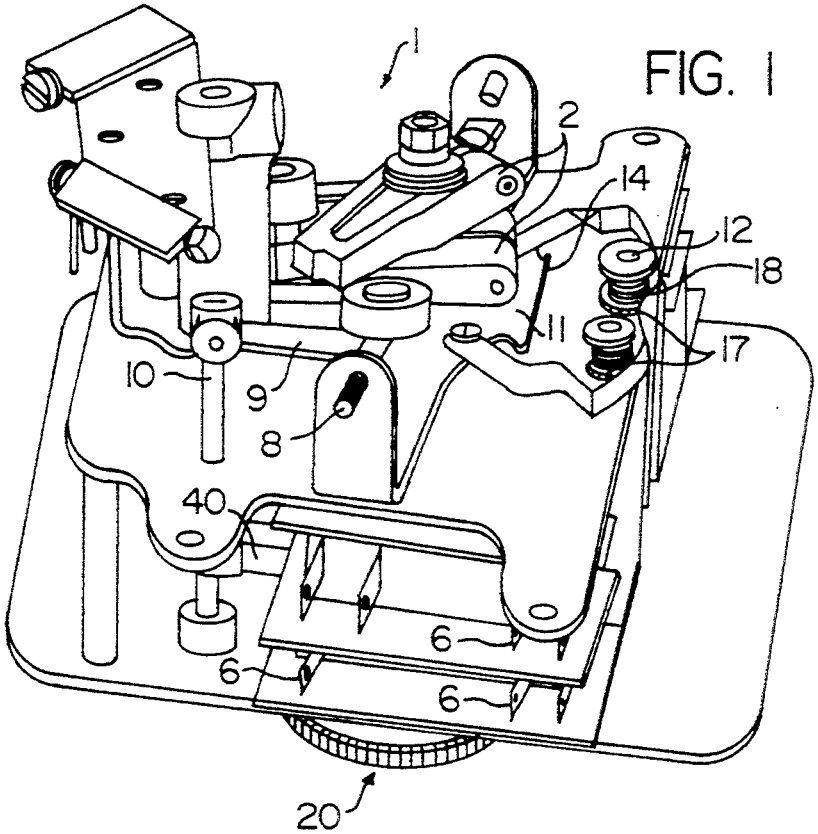
FIG. 1 illustrates a limiter assembly for electric actuators, seen in perspective and in its entirety.

With reference to the drawings, 1 denotes a limiter assembly for electric actuators, comprising two cams 2 which are means for controlling a plurality of limit switches or other suitable limiters 3. The cams 2, 2 are rigidly associated with a common shaft 4 carrying two gears 20 at the bottom thereof. There cams, shaft, and gears are rotatable as one, by way of which the assembly is coupled to an electric actuator (not illustrated in the drawings).

Each limit switch or other suitable limiter 3 comprises a plurality of micro switches, each switch having a related actuator button (not shown) and terminals 6. The limit switches have normal and off-normal positions which relate to whether the switches are or are not operated. For example, if a set of microswitch terminals are closed in the normal position, they are open in the off-normal position, and vice versa.

The cams 2, 2 have a substantially stepped profile designed to engage a roller 7 or 5 in such a way as to enable two-stage operation of the microswitches. A first step of the profile sets the system in such a way that the torque microswitch controlling the opposite direction of movement will not cut in during the first part of the cam travel (release of the valve at maximum permissible torque). The second step operates the microswitches to stop the motor without the torque control system cutting in.

Each roller 5, 7 is carried by a corresponding arm 9 connected via a shaft 10 to flexible strips 40 which serve to operate the microswitch actuator buttons 41 of the limiters 3 by applying a mechanical pressure. The arms 9 are positioned in such a way as to strike against a substantially Y-shaped element 11 which is capable of movement internally within a slot 14 and designed to operate one or more buttons of the limiters by applying a mechanical pressure there to. The number 8 denotes a screw for adjusting the interaction between each arm 9 and the moving element 11. By conditioning the system to prevent the torque control from cutting in when the motor is operated in the opposite direction, the first step of the cam profile produces what is termed a 'mechanical by-pass' by persons skilled in the art.

The number 15 denotes a ribbon, fashioned from a rectangular band of metal which is bent and shaped in such a way that the ends can be screwed or otherwise anchored to the moving element 11, and affording two teeth or projections 16 issuing from one face. The teeth 16 are positioned in such a way as to engage the teeth of two corresponding and freely rotatable sprockets 17 mounted relative to shafts 12. Each sprocket 17 is partly enveloped by a spring 18 coiled in such a way that when the corresponding tooth 16 projecting from the ribbon 15 is engaged between the teeth of the sprocket 17, the shaft 12 is able to rotate in one direction only, namely, the direction in which the spring is coiled around the sprocket.

More exactly, the topmost end of each shaft 12 carries the sprocket 17, and a seating element 13 for the spring 18, the spring being wound tightly around this same element 13 and around a part of the sprocket 17 in such a way as to allow movement of the sprocket 17 in one direction only, relative to the shaft 12.

At the ends farthest from the ribbon 15, the two shafts 12 respectively carry pinions 19 in mesh with a gear 20 coupled to the actuator by way of further mechanical transmission components.

Figure 2:
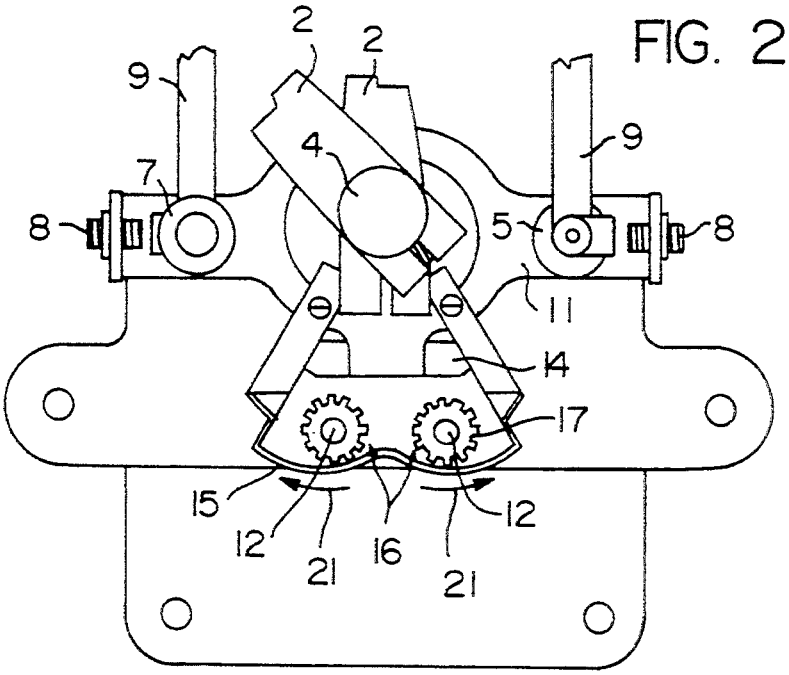
FIG. 2 is a plan view of the device according to the invention, seen in the at-rest condition.

With reference to FIGS. 2 and 5, which respectively illustrate an at-rest configuration and a position in which the microswitches are activated, the two arrows denoted 21 indicate the directions in which the sprockets 17 are rotatable.

It will be clear from FIG. 5, in which the sprocket denoted 17*a* is indicated as being rotatable only anticlockwise in relation to the relative shaft 12, that when the tooth 16 of the ribbon 15 engages the teeth of the sprocket 17*a* and the moving element 11 operates the microswitch of the limit switches or limiters 3, the moving element 11 is prevented from retracting by reason of the sprocket 17*a* being rotatable relative to the shaft 12 in one direction only.

The ultimate release of a device according to the invention occurs automatically when the actuator rotates in the direction opposite that which caused the device to operate initially. While the shafts 12 and the relative sprockets 17 are capable of rotation in either direction, the engagement of a tooth 16 of the ribbon with one of the sprockets has the effect of inhibiting the return movement of that sprocket 17, given that the corresponding pinion 19 at the far end of the shaft is in constant mesh with the gear 20.

A mechanical device according to the invention is connected to a torque control system (not shown) and serves to prevent the occurrence of hunting or 'pumping' throughout the entire operating stroke of motors or actuators coupled through a reversible kinematic chain, as used for valves.

The ribbon 15, the moving element 11, sprockets 17, shafts 12, springs 18 and seatings 13 and the gear 20 together constitute mechanical means by which to retain one or more travel limiters in position, i.e. engaged, even after the action of the trigger by which engagement is brought about (the moving element 11) has been discontinued.

What is claimed:

1. A mechanical device for ensuring an irreversibility in a limiter assembly including at least one limit switch (3) having a normal and an off-normal position, said mechanical device comprising means responsive to an initiating action coupled to move said at least one limit switch (3) to said off-normal position for the duration of the initiating action, mechanical means comprising a ribbon (15)of material which is rigidly associated with a moving element (11 ), wherein said moving element operates said at least one limit switch (3), said ribbon having two projections (16), two toothed sprockets (17) mounted to freely rotate on two individually associated shafts (12), said two projections selectively engaging teeth on individually associated ones of said sprockets, each of said shafts being partly enveloped by an individually associated spring (18) coiled in such a direction that when either projection (16) engages the teeth of the corresponding sprocket (17), and the shaft (12) individually associated therewith is allowed to rotate in only one direction, concurrently with the direction in which the spring is coiled relative to the sprocket, wherein after termination of the initiating action, said at least one limit switch is moved to said normal position.

2. A device as in claim 1, further comprising two pinions mounted on ends of individually associated ones of the shafts, said shaft ends being remote from the sprockets and the ribbon, a common gear wheel in mesh with said two pinions, said common gear being connected to the at least one limit switch by way of mechanical transmission components.

3. A device as in claim 1 further comprising two elements on which the springs are seated, said elements being mounted on individually associated ones of the shafts and enveloped together with the freely revolving sprockets by the springs.

4. The mechanical device of claim 1 further comprising at least one gear (20) driven by said shafts, said gear providing an output interconnection for cooperating with means controlled by said mechanical device, and means responsive to said at least one limit switch while in said off-normal position for preventing a reversing of a direction in which said gear turns.

5. The mechanical device of claim 4, and a pinion gear on each of said shafts, said pinion gears meshing with and driving said gear.

* * * * *